United States Patent [19]

Brodsky et al.

[11] Patent Number: 5,059,129

[45] Date of Patent: Oct. 22, 1991

[54] CONNECTOR ASSEMBLY INCLUDING BILAYERED ELASTOMERIC MEMBER

[75] Inventors: William L. Brodsky, Binghamton; Thomas G. Macek; John J. Squires, both of Endicott, all of N.Y.

[73] Assignee: International Business Machines Corporation, Armonk, N.Y.

[21] Appl. No.: 674,243

[22] Filed: Mar. 25, 1991

[51] Int. Cl.[5] ..... H01R 9/09

[52] U.S. Cl. ..... 439/67; 439/70; 439/71

[58] Field of Search ..... 439/67–74

[56] References Cited

U.S. PATENT DOCUMENTS

| | | | |
|---|---|---|---|
| 3,586,917 | 6/1971 | Oates | 174/15 |
| 3,861,135 | 1/1975 | Seeger, Jr. et al. | 174/88 R |
| 3,883,213 | 5/1975 | Glaister | 339/61 M |
| 3,971,610 | 7/1976 | Buchoff et al. | 339/17 R |
| 4,018,496 | 4/1977 | Bilsback | 339/17 F |
| 4,029,999 | 6/1977 | Neumann et al. | 361/400 |
| 4,064,623 | 12/1977 | Moore | 339/DIG. 3 |
| 4,116,516 | 9/1978 | Griffin | 339/17 F |
| 4,150,420 | 4/1979 | Berg | 361/401 |
| 4,184,729 | 1/1980 | Parks et al. | 339/17 F |
| 4,329,732 | 5/1982 | Kavli et al. | 361/283 |
| 4,513,353 | 4/1985 | Bakermans et al. | 439/71 |
| 4,538,865 | 9/1985 | Wakabayashi et al. | 339/17 F |
| 4,587,596 | 5/1986 | Bunnell | 339/17 M |
| 4,597,617 | 7/1986 | Enochs | 339/17 CF |
| 4,647,125 | 3/1987 | Landi et al. | 339/17 F |
| 4,768,971 | 9/1988 | Simpson | 439/329 |
| 4,787,854 | 11/1988 | Le Parquier | 439/67 |
| 4,849,856 | 7/1989 | Funari et al. | 174/16.3 |
| 4,878,846 | 11/1989 | Schroeder | 439/65 |
| 4,902,234 | 2/1990 | Brodsky et al. | 439/67 |
| 4,914,551 | 3/1990 | Anschel et al. | 361/389 |
| 4,936,783 | 6/1990 | Petersen | 439/70 |
| 4,937,707 | 6/1990 | McBride et al. | 361/400 |
| 5,015,191 | 5/1991 | Grabbe et al. | 439/71 |

FOREIGN PATENT DOCUMENTS

| | | |
|---|---|---|
| 0055640 | 11/1981 | European Pat. Off. . |
| 0700490 | 12/1953 | United Kingdom . |
| 1488226 | 10/1977 | United Kingdom . |

OTHER PUBLICATIONS

IBM TDB vol. 28, No. 7, 12/85, pp. 2855,2856, "Flexible Module Carrier Direct Connection Package".

Dow Corning Bulletin 17-047, 07/71, Information About Silastic Silicone Rubber.

IBM TDB vol. 25, No. 1, 06/82, pp. 370,371, "Electrical Connector for Flat Flexible Cable".

IBM TDB vol. 25, No. 7A, 12/82, pp. 3438–3441, "Planar Electrical Connector".

vol. 26, No. 3A, 08/83, pp. 1152,1153, "Improved Flat Flexible Cable Connector".

(TDB) IBM TDB vol. 26, No. 12, 05/84, p. 6657 "Flex Circuit Zero Insertion Force Connector".

IBM TDB vol. 27, No. 3, 08/84, pp. 1499–1501, "Separable, Conformal, Low Profile Connector Means".

IBM TDB vol. 7, No. 1 06/64, pp. 101,102, "Solderless Electrical Contacts".

IBM TDB vol. 10, No. 10, 03/68, pp. 1462,1463, "Connectors".

IBM TDB vol. 13, No. 6, 11/70, p. 1589, "Contacting System".

IBM TDB vol. 18, No. 2, 07/75, p. 340, "High-Density Strip Line Card Connector".

IBM TDB vol. 21, No. 10, 03/79, pp. 3987,3988, "Coaxial Connector".

IBM TDB vol. 22, No. 2, 07/79, pp. 523,524, "Shielded Connectors".

IBM TDB vol. 24, No. 2, 07/81, pp. 905,906, "Circular Clip Pressure Connector".

*Primary Examiner*—Paul A. Bradley

*Attorney, Agent, or Firm*—Lawrence R. Fraley

[57] ABSTRACT

An electrical connector assembly including a bilayered elastomeric element of integral construction for providing effective contact force (pressure) between corresponding arrays of conductors located on two circuit members (e.g., one a flexible circuit and the other a more rigid, circuit board or card). High density connections are assured in a sound, effective manner. The elastomer, preferably silicon rubber, includes a base layer with several spaced openings therein and an adjacent layer of several upstanding projections (e.g., cylindrical or box-like) spacedly located relative to the adjacent openings within the first layer. The first layer openings accommodate bulged elastomeric during compression to assist in preventing undesirable elastomeric buckling, thereby assuring the desired contact force (pressure) application.

12 Claims, 4 Drawing Sheets

CONNECTOR ASSEMBLY INCLUDING BILAYERED ELASTOMERIC MEMBER

TECHNICAL FIELD

The invention relates to electrical assemblies and particularly to such assemblies wherein at least two circuits are electrically connected. Even more particularly, the invention relates to such assemblies wherein external pressure is applied to one or both of the circuit components (e.g., printed circuit, flexible circuit) to effect the connection.

BACKGROUND OF THE INVENTION

Utilization of electrical connector assemblies for the purpose of electrically coupling various circuit devices is, of course, well known, with several examples being shown and described in the following patents and publications:

U.S. Pat. No. 3,861,135—R. E. Seeger, Jr. et al
U.S. Pat. No. 3,883,213—F. J. Glaister
U.S. Pat. No. 3,971,610—L. S. Buchoff et al
U.S. Pat. No. 4,184,729—H. L. Parks et al
U.S. Pat. No. 4,902,234—W. L. Brodsky et al
IBM Technical Disclosure Bulletins:
Vol. 18, No. 2 (7/75), p. 340
Vol. 22, No. 2 (7/79) pp. 444,445
Vol. 25, No. 7A (12/82, pp. 3438-3441

In the design of connector assemblies wherein direct contact is desired between the individual electrical conductors (e.g., printed circuit lines, contact pins, etc.) which constitute part of the circuit devices being coupled, as in the case of the instant invention, application of a reliable contact pressure of sufficient duration and capable of withstanding possible adverse environmental conditions (e.g., heat, moisture) is considered essential. Excessive pressure can result in damage to various components of the assembly (particularly the conductors) during both assembly and/or operation. Additionally, the provision of such pressure has heretofore typically been accomplished through the utilization of relatively large components (e.g., connector housings) needed to produce these assemblies, thus also adding unnecessarily to the cost thereof. In those assemblies subjected to adverse environmental conditions such as mentioned above, failure to withstand same has also resulted in such problems as contact corrosion, reduced contact pressure, increased maintenance costs, etc.

In the aforementioned U.S. Pat. No. 4,902,234, assigned to the same assignee as the instant invention, there is defined a connector assembly wherein an elastomeric pressure exertion member is utilized to provide reliable contact pressure against at least one of the circuit members (e.g., a flexible circuit). This exertion member includes a base plate, a plurality of individual compressible elements located on one side of the plate, and a resilient member located on the plate's other side. The disclosure of 4,902,234 is incorporated herein by reference.

As will be defined hereinbelow, the connector assembly of the invention provides a sound, reliable contact pressure of relatively low magnitude through the utilization of effective materials which are relatively inexpensive and which can withstand adverse environmental conditions such as excessive heat and moisture. As understood, this assembly represents an improvement over the concept defined in U.S. Pat. No. 4,902,234. It is believed that such a connector assembly would constitute a significant advancement in the art.

DISCLOSURE OF THE INVENTION

It is a primary object of the invention to enhance the art of electrical connector assemblies.

It is another object of the invention to provide an electrical connector assembly which provides a sound, effective contact pressure in a reliable manner.

It is yet another object of the invention to provide such a connector assembly which is operable in relatively adverse environmental conditions such as high heat and moisture.

It is a still further object of the invention to provide a connector assembly possessing, among others, the several features described herein and yet which can be produced on a relatively large scale (e.g., mass production), thus reducing the overall cost thereof in comparison to many known connector assemblies of the prior art.

These and other objects are achieved according to one aspect of the invention through the provision of an electrical connector assembly comprising a first circuit member having a plurality of electrical conductors thereon, a second circuit member also having a plurality of electrical conductors thereon, a pressure exertion member for exerting a predetermined pressure against the second circuit member to thereby cause electrical contact between respective conductors of the two circuit members, and means for retaining the pressure exertion member against the second circuit member to cause exertion of said force. The pressure exertion member comprises a bilayered elastomeric element including a first layer with a pattern of openings therein and a second layer constituting a plurality of upstanding projections for aligning with respective ones of the second circuit's conductors and thereby exerting said predetermined pressure against same when retained by the retaining means.

BEST MODE FOR CARRYING OUT THE INVENTION

For a better understanding of the invention, together with other objects, advantages and capabilities thereof, reference is made to the following disclosure in connection with the aforementioned drawings.

Figure 1:
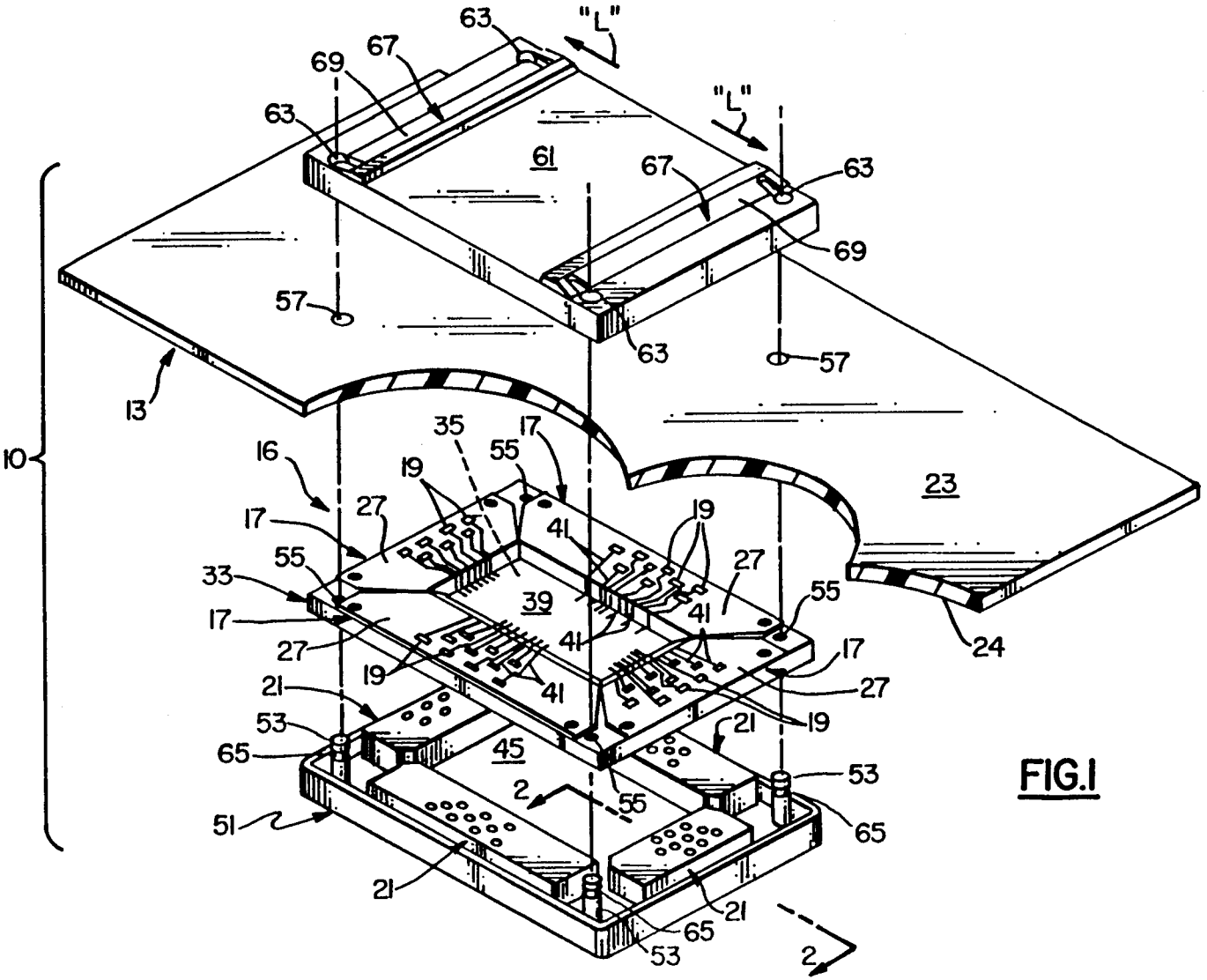
FIG. 1 is an exploded isometric view of an electrical connector assembly in accordance with one embodiment of the invention.

In FIG. 1, there is shown an electrical connector assembly 10 in accordance with a preferred embodiment of the invention. Assembly 10 includes a first circuit member 13 with a plurality of electrical conductors 15 thereon (see FIGS. 2–4), a second circuit member 16 including a plurality of separate circuit sections 17 forming part thereof, each including a plurality of conductors 19 thereon, and a plurality of individual pressure (or force) exertion members 21, each for providing a predetermined pressure (or force) of relatively low magnitude against respective ones of the circuit sections 17 sufficient to cause the respective conductors 15 and 19 of circuit members 13 and 16, respectively, to contact each other in a sound, effective manner. As understood herein, each exertion member 21 assures a sound electrical connection between each of the respective conductors while at the same time uniquely compensating for surface elevation variations in either/both the invention's conductors. Specifically, the invention assures sound connection between the conductors thereof despite differences in thickness of such conductors and/or the flexible substrate upon which one array of these is positioned. As further understood, the invention is able to provide this predetermined pressure over a relatively prolonged period of time, despite deleterious conditions such as relatively high heat and/or moisture to which the invention may be subjected.

Although four second circuit sections 17 and a similar number of exertion members 21 are shown, it is understood that in the broader aspects of the invention, only one of each of these is necessary to accomplish the invention's objectives.

Figure 2:
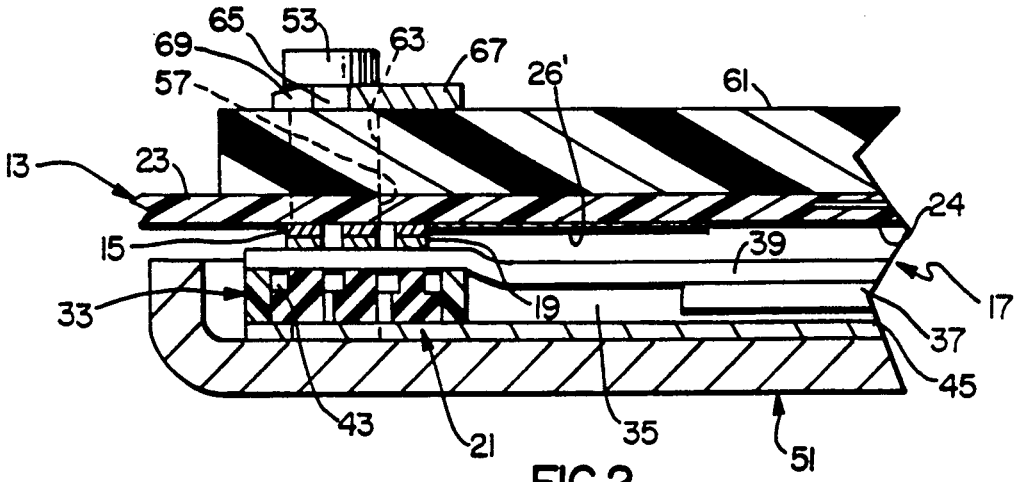
FIG. 2 is a partial, side elevational view, in section and on an enlarged scale, of the assembly of FIG. 1, when assembled.
Figure 3:
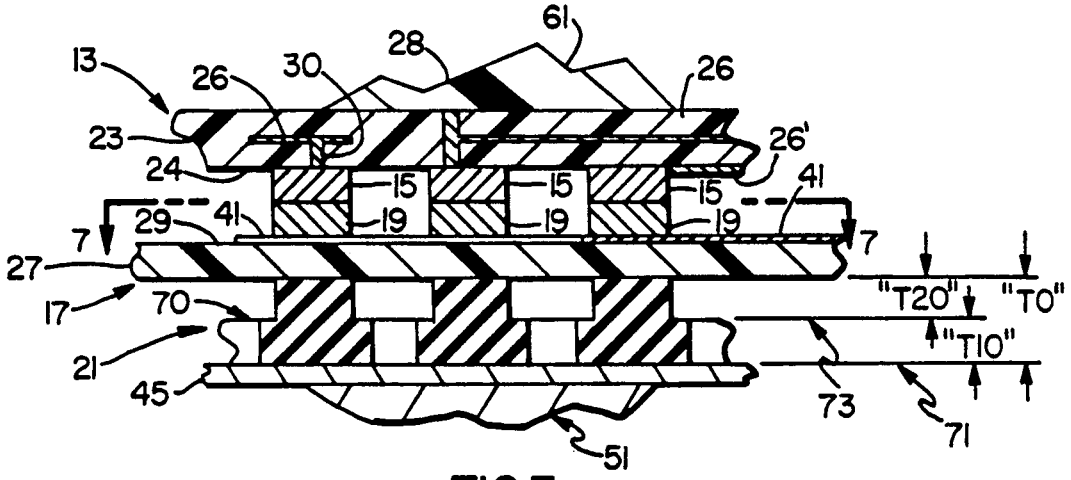
FIGS. 3 and 4 are partial elevational views, in section and on an enlarged scale over the view in FIG. 2, illustrating, respectively, the invention prior to and during actuation thereof.
Figure 4:
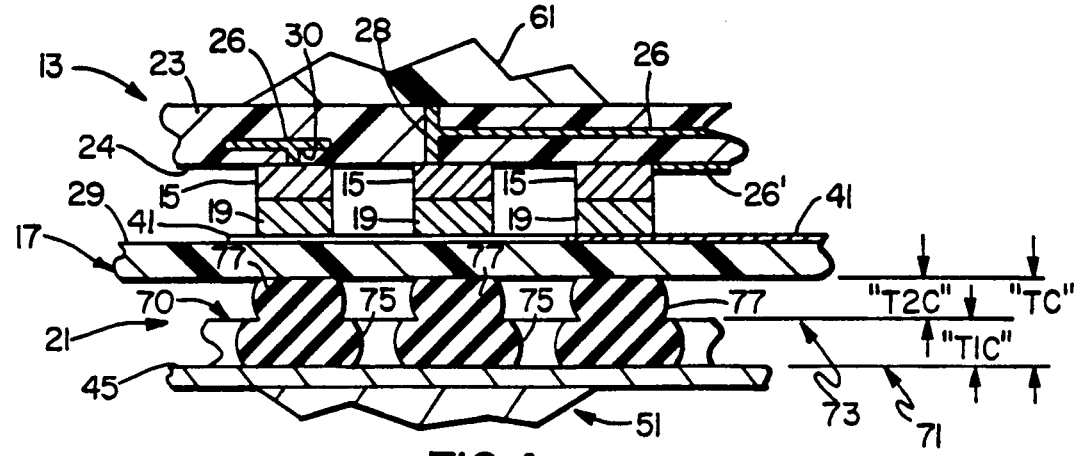

In a preferred embodiment, first circuit member 13 comprises a printed circuit board having a relatively rigid insulative substrate 23. Substrate 23 is preferably of a known material (e.g., epoxy) and includes the defined conductors 15 located along a first surface 24 thereof. Each conductor 15, as shown, is preferably of flat configuration and comprised of a sound metallic conductive material (e.g., copper). Each conductor 15 is positioned on the epoxy substrate 23 using techniques known in the printed circuit art and further description is thus not believed necessary. in one example of the invention, substrate 23 possessed a thickness of about 0.062 inch while each of the copper conductive members 15 possessed an average thickness of only about 0.001 inch. As defined, each conductor 15 is substantially flat in configuration and thus constitutes a "metallic pad" to which connection is made. As defined below, such a configuration (flat) is also preferred for the conductors 19 of the invention's second circuit member. Accordingly, the invention provides for sound connection between opposing, relatively flat metallic conductors in the manner depicted herein. It is understood, however, that the invention is not limited to such flat conductors and that alternative designs for these elements may be utilized, with suitable examples including those of the dendritic variety such as defined in Canadian Patent 1,121,011 and in IBM Technical Disclosure Bulletins Vol. 22, No. 7 (Dec., 1979), pg. 2706 and Vol. 23, No. 8 (Jan., 1981), pg. 3631, the disclosures of which are incorporated herein for reference. Still another conductor suitable for use herein (particularly as conductor 15) is a pin-type conductor which includes a projecting tail or tip segment capable of insertion within substrate 23 (e.g., to connect to internal circuitry therein). One such example is defined in U.S. Pat. No. 4,976,626, the disclosure of which is incorporated herein by reference. Examples of internal circuitry (26) are depicted in FIGS. 3 and 4 and are well known in the printed circuit board (particularly that of the multilayered type) art. Such circuitry may be in the form of signal, power or ground planes. Such planes may be electrically coupled to conductors 15 by known means, including plated-through-holes (represented in FIGS. 3 and 4 by the numeral 28) or "vias" (represented by numeral 30) which only partially penetrate the board's thickness. Circuit member 13 may also include external circuitry 26' thereon (FIGS. 2–4) which in turn may be coupled to selected ones of the arrayed conductors 15, depending on the operational requirements for assembly 10.

Each circuit section 17 of overall member 16 preferably comprises a flexible substrate 27 having the described conductors 19 located on an upper surface 29 thereof (FIGS. 3 and 4). As stated, conductors 19 are also preferably of substantially flat configuration and, in one embodiment of the invention were comprised of copper and deposited on substrate 27 using known printed circuit technology. Again, however, use of conductors of different shapes (e.g., dendritic) is readily possible. The corresponding flexible substrate in this example was comprised of electrically insulative material (polyimide) and possessed a thickness within the range of about 0.002 inch to about 0.005 inch, thus assuring the flexibility desired for this element.

As shown in FIG. 1, four separate circuit sections 17 are spacedly located about a carrier or frame member 33 (see also FIG. 2), which member is not shown in FIGS. 3 and 4 for purposes of clarity. Frame 33 is preferably plastic (a preferred material being polycarbonate), and of rectangular shape such that each circuit 17 occupies (is positioned on) a respective one of the frame's longitudinal sides. As depicted in FIG. 2, frame 33 defines an internal opening 35, also of rectangular shape, which opening is designed to accommodate a semiconductor device (chip) 37 (FIG. 2). Chip 37 is located on a lower surface of a common section 39 of flexible substrate joined to each of the individual circuits 17 which thus append therefrom. Common sections 39, being so joined, thus suspend chip 37 above the remaining structure of assembly 10 (to be defined below) so that the chip is spaced therefrom. As shown particularly in FIG. 1 (and FIGS. 3 and 4), circuitry 41 is used on the upper surface of flexible circuits 17 and extends into common section 39. This circuitry is connected to respective contact sites (not shown) on chip 37 to provide the desired operational features for this portion of assembly 10. This circuitry 41 may pass through the dielectric common section 39 (e.g., using plated-through-holes, as defined above) to be coupled to such contact sites (which are positioned along the surface of chips 37 facing and in contact with section 39. It is also possible to locate chip 37 on the opposite side of the depressed common section 39 from that shown and thus provide direct connection to the terminal ends of circuitry 41. The orientation depicted herein for chip 37 is preferred, however, to assure enhanced heat sinking during operation of assembly 10. Although chip 37 is shown in a spaced orientation, it is possible to thermally join (e.g., using thermal paste) this element to the adjacent metallic support (45, defined below) to even further enhance heat transfer.

In comparing FIGS. 1 and 2, it can be seen that each pressure exertion member 21 is positioned within a channel 43 within a respective side of the rectangular frame 33. Additionally, each member 21 also rests on a relatively rigid, metallic common support member 45, which, in a preferred embodiment of the invention, is a flat stainless steel plate having a thickness of about 0.025 inch. Members 21 are precisely spacedly aligned on plate 45 relative to each other and, of course, relative to the ultimate positions of respective second circuits 17. Circuits 17 are in turn precisely located on common frame 33, e.g., using adhesives or pin-in-hole techniques. (Should the latter be used, each flexible circuit would include precisely oriented apertures designed to accommodate a projecting pin located on the frame's upper surface). Members 21 may be similarly located, a preferred technique being to vulcanize these directly to rigid support member 45 using known vulcanizing procedures.

Assembly 10, as best seen in FIG. 1 and also partially in FIGS. 2–4, further includes a cap (or cover) member 51 which is designed for being securedly positioned on circuit member 13 in precise orientation relative to the circuitry thereon. Cap 51 is preferably metallic (e.g., aluminum) to assure effective heat sinking and structural rigidity and includes a plurality (four) of metallic upstanding posts 53 which pass through respective apertures 55 located at the corners of rectangular frame 33, and further through corresponding apertures 57 (only two shown in FIG. 1) in circuit member 13. Posts 53 are preferably press fit within stainless steel and are the supper surface of cap 51. Each post is "captured" on the opposite side of member 13 to hold it in place. In a preferred embodiment, a substantially solid "stiffener" member 61 (e.g., of a suitable plastic such as polyphenylene sulfide or of metallic material such as stainless steel), including apertures 63 therein for having the terminal ends of posts 53 extending therethrough, is used to provide structural reinforcement at this location of assembly 10. Each such post terminal end further includes a slotted section 65 therein which in turn is designed for being engaged by a movable retainer 67. Two retainers 67 are used, one for each aligned pair of posts 53, each such retainer including a cam surface 69 to facilitate post "capture" during sliding engagement therewith. Retainers 67 move in the lateral directions indicated by the arrows "L" in FIG. 1, it being understood of course that these may move in an opposite direction (toward one another) and still function as intended.

Figure 5:
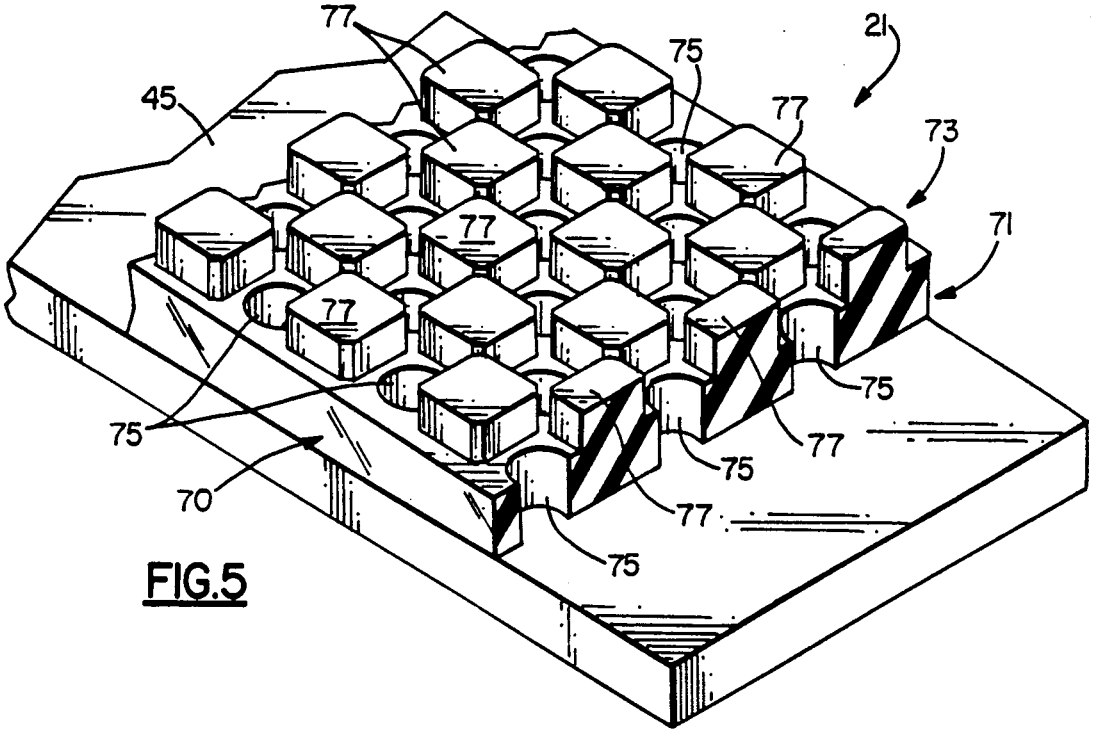
FIG. 5 is a partial isometric view of an elastomeric element and supporting plate member in accordance with one embodiment of the invention.
Figure 6:
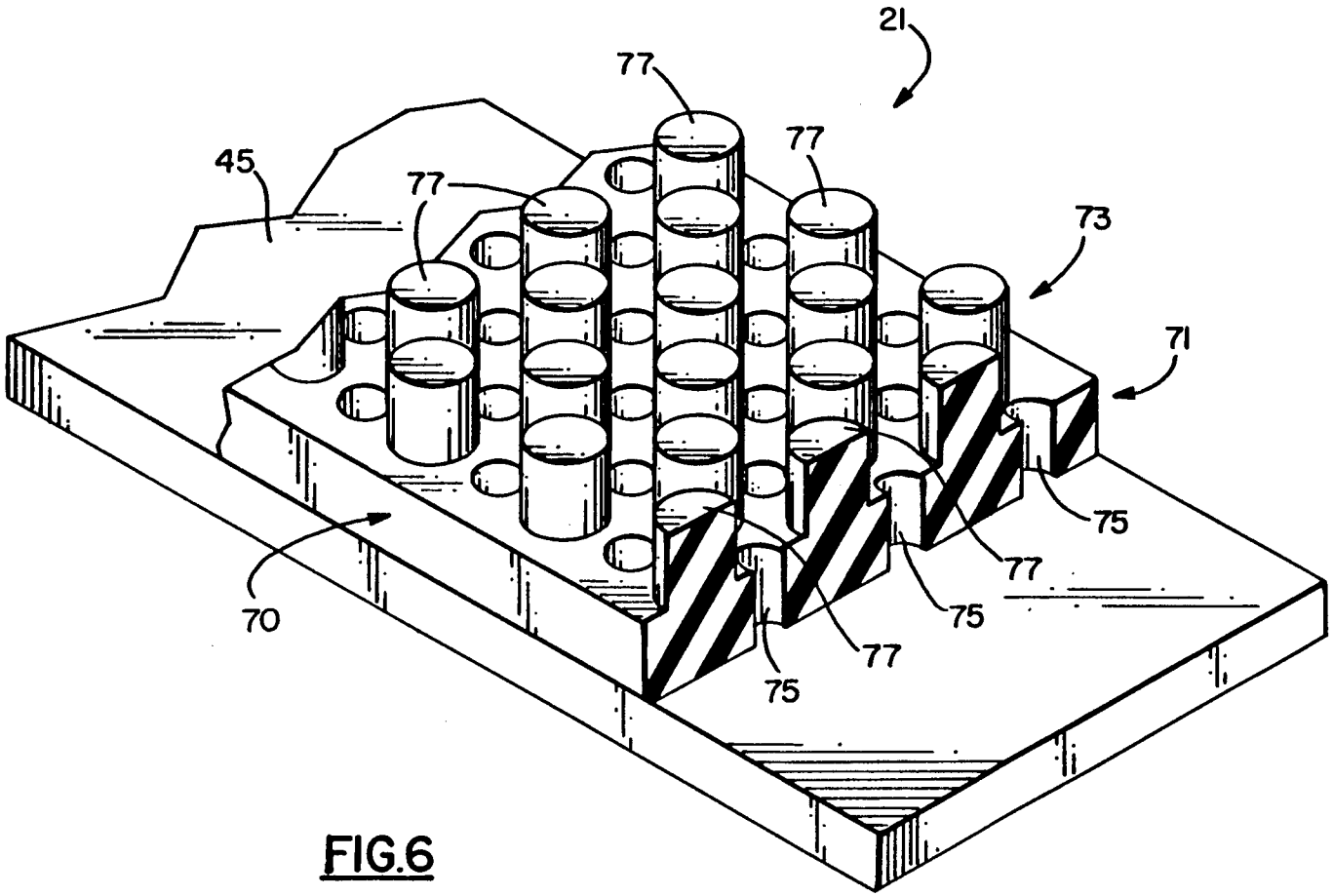
FIG. 6 is a partial isometric view of an elastomeric element in accordance with another embodiment of the invention.

In FIGS. 5 and 6, there are shown preferred embodiments for pressure exertion members 21 capable of use in assembly 10. As will be explained, the embodiment depicted in FIG. 6 represents the more preferred embodiment over that of FIG. 5. Both, however, are readily capable of providing the predetermined pressure (force) against the invention's second circuit member to thus assure the sound, effective connections required herein. Exertion member 21, as depicted in FIGS. 5 and 6, comprises a bilayered elastomeric element 70 having a first layer 71 and an adjacent second layer 73. Elastomeric element 70 is preferably of integral construction and thus molded within a singular mold to the desired configurations (defined hereinbelow).

Proper selection of an appropriate elastomeric material for the invention's compressible exertion members is essential to achieve the desired results of long term stress retention, relatively low magnitude pressure (as defined herein), and operability at relatively high temperatures and humidity. A preferred material selected for use in the instant invention is a low compression set polysiloxane rubber available from the DOW Corning Corporation and sold under the name Silastic LCS-745U (Silastic is a registered trademark of the Dow Corning Corporation). This clean, low modulous elastomer demonstrates approximately a seventy to eighty percent retention of residual compressive stress when loaded in constant deflection at an elevated temperature (e.g., 100 degrees C.) for a prolonged period.

The aforementioned silicone rubber is available from the DOW Corning Corporation in stock form. After being press vulcanized, such parts are serviceable (operable) over a temperature range of from about −73 degrees Celsius (C.) to +250 degrees C. and possess the highly desired features of good reversion (heat resistance), low compression set and good resistance to hot oils, water and steam. The described silicone rubber, as molded, possesses a durometer hardness (Shore A) of 52, a tensile strength of about 830 pounds per square inch and an elongation of about 260 percent.

Figure 7:
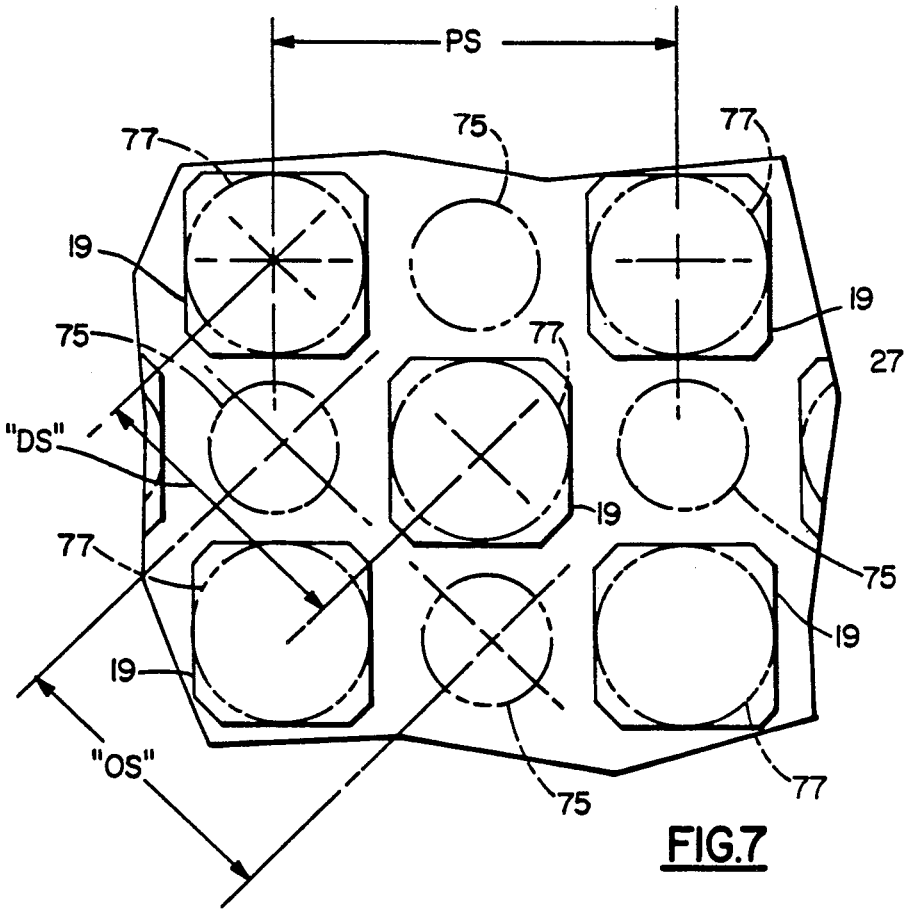
FIG. 7 is a much enlarged plan view, as taken along with the line 7—7 in FIG. 3, illustrating the relative patterns of second circuit conductors, upstanding elastomeric projections and spaced openings (within the elastomeric) in accordance with one embodiment of the invention.

The first layer 71 of element 70 is preferably of substantially solid configuration and includes a plurality of openings 75 spacedly located therein in accordance with a predetermined pattern (see particularly FIG. 7). These openings are considered essential for reasons stated below. Each opening 75 is preferably of substantially cylindrical configuration and extends through the entire thickness ("T10" in FIG. 3). Dimension "T10" represents the original thickness of first layer 71 prior to full compression of elastomeric element 70 so as to achieve the desired connections between respective arrays of conductors 15 and 19. As further seen in FIG. 7, these openings 75 occupy a substantially rectangular pattern and, in one embodiment of the invention, were spaced apart (dimension "OS" in FIG. 7) at a distance within the range of from about 0.068 inch to about 0.074 inch. Each cylindrical opening in turn possessed an internal diameter of only about 0.030 inch.

It is understood that openings possessing this configuration and pattern are preferably utilized in both of the embodiments of elastomeric element 70 as depicted in FIGS. 5 and 6. The aforementioned spacings are also preferably utilized in both such embodiments.

In the embodiment of FIG. 5, the second layer 73 for element 70 includes a plurality of upstanding projections 77 located in a pre-established pattern, this pattern being substantially identical to that for the respective array of conductors 19 located on the flexible circuit member 17 which is engaged (and acted against) by the respective elastomeric element 70. In two examples of the invention, a total of 48 and 78 projections 77 were utilized per individual elastomeric element to align with a similar number of conductors 19 on the flexible circuit member 17 being engaged. Thus, a total of about 190 to about 350 such projections 77 are preferably utilized in an assembly 10 using four such elastomeric elements and associated flexible circuit sections. Preferably, a similar number of such projections are utilized for the embodiment of FIG. 6.

Understandably, the defined projections 77 do not physically engage the respective conductors 19, but instead engage the back surface of the dielectric (e.g., polyimide) of the flexible circuit member. Significantly, however, these projections individually align with the respective conductors located in the defined pattern on the opposite surface thereof in order to achieve the ultimate application of pressure force taught herein. Of further significance, however, the invention is able to provide such force application even in the event of slight displacement between the projections and associated conductors.

In the above example, the pressure provided by a singular elastomeric element 21 was within the range of about ten to about fifty pounds per square inch, said force deemed sufficient to provide the appropriate sound connections required herein. As part of this application, it is considered essential that each of the upstanding projections 77 (as well as those in FIG. 6) are compressed from about fifteen to about thirty-five percent of the original, unstressed height (thickness) thereof during exertion of the defined pressure. (Ideally, a compression of twenty-five percent is achieved.) Such an unstressed height (thickness) is represented by the dimension "T20" in FIG. 3. Significantly, both first and second layers 71 and 73 compress to the above extent (about fifteen to about thirty-five percent of original, unstressed height) when in final compression. Such compressed thicknesses are illustrated in FIG. 4 by the dimensions "T1C" and "T2C", respectively. As further seen in FIG. 4, each of the compressible upstanding projections and associated, compressible first layer are thus compressed to a total thickness represented by the dimension "TC" in FIG. 4, from an original thickness of "TO" (FIG. 3).

Most significantly, this dual compression is attained without buckling or other undesired disfigurement of the elastomeric element, thus assuring the required pressures taught herein. This unique capability is assured, in part, through the utilization of the aforedefined openings 75 which, during compression, are also compressed in the manner indicated in FIG. 4. That is, the outwardly expanding elastomeric for first layer 71 extends within the adjacent accommodating opening 75 to maintain the vertical integrity of each layer within the composite elastomeric element.

In the embodiment of FIG. 5, each upstanding projection 77 is preferably of substantially box-like configuration (thus of substantially rectangular cross-sectional configuration when depicted in both elevational and plan views). In the embodiment of FIG. 6, each projection 77 is of substantially cylindrical configuration, possessing, in one embodiment of the invention, an outer diameter of about 0.047 inch. In comparing FIG. 7 (FIG. 7 directed to the embodiment of element 70 as shown in FIG. 6), the specific pattern for such cylindrical projections 77 relative to the adjacent openings 75 and the corresponding, respective conductors 19 is seen. These projections and adjacent openings, located opposite the conductors 15 (on the opposite side of substrate 27) are thus hidden and represented by dashed lines. As further seen in FIG. 7, the center-to-center spacing between cylindrical projections 77 located on directly opposite sides of the interim accommodating opening 75 is represented by the dimension "PS". In one example, this spacing was within the range of from about 0.098 to about 0.102 inch. The associated diagonal spacing, represented by the dimension "DS" in FIG. 7 between the immediately adjacent cylindrical projections 77, in the pattern as shown in FIG. 7, was, in one embodiment of the invention, within the range of from about 0.065 inch to about 0.075 inch. When utilizing projections in accordance with the patterns illustrated herein and at dimensions as defined herein, it is possible in the instant invention to provide suitable connections between arrays of similarly patterned conductors which occupy the respective substrate at a density of about 200 per square inch. This extremely high density of such conductors is, of course, a highly desirable design feature for microelectronic and similar circuits in which the instant invention may be utilized. As stated, such circuits are particularly useful in the information handling system (computer) field.

With particular attention to FIG. 7, it is also seen that each of these conductors 19 (as well as conductors 15, for that matter) is of substantially rectangular configuration. That is, each conductor 19 is a substantially rectangular metallic pad possessing the thicknesses mentioned above. Such pads are located on respective substrates in the patterns illustrated so as to be positioned relative to each other at center-to-center spacings cited above. It is understood, of course, that other configurations for such pads, including cylindrical, are readily possible. In accordance with teachings herein, the use of rectangular pads in combination with cylindrical projections is preferred to assure maximum pressure application against each conductor when assembly 10 is in final (compressed) condition.

In order to assure that the deflections of each layer 71 and 73 are maintained in the desired range stated above, the thickness of each layer needs to be inversely proportional to the "spring rate" of each layer. By definition, the spring rate per layer is the force required to compress each respective layer a given distance. Use of a bilayered structure as defined herein assures that buckling of the final structure is substantially prevented. Specifically, the substantially solid lower layer 71, including the defined pattern of openings therein relative to the adjacent upstanding projections for the adjacent first layer, increases the buckling load of the lower layer and allows use of shorter height upstanding projections, thus creating a more stable structure. Use of such an integral, apertured layer for the layer which engages the flexible circuit is not essential because force application is only deemed necessary where individual paired arrays of contacts are being mated. Because the total force contained by the structure is the elastomer compressive stress at the elastomer-flexible circuit interface times the interface contact area, superfluous areas of contact are a detriment. It is for this reason that cylindrical projections (FIG. 6) are desired over those of the substantially box-like configuration (FIG. 5), as such configurations, using the dimensions cited herein, possess approximately 20% less area of contact than rectangular (box-like) projections of the same external (width) dimensions. Additional reasons for utilizing cylindrical projections include ease of mold construction, each of mold filling, reduction in stress gradients due to corners, and the fact that the corners of the rectangular projections increase the opportunity for engagement between adjacent such projections. This is substantially eliminated using cylindrical projections.

Regardless of whether rectangular (box-like) or cylindrical projections are used, the elastomeric elements as taught herein possess the ability to conform to uneven surface elevations within the respective components being joined such that low points thereof receive sufficient force to assure proper contact pressure. As understood, this requires an elastomer having a relatively low spring rate such that only a few percent compression is required to adjust for out-of-flatness tolerances in adjacent surfaces. Total deflection (e.g., twenty-five percent) thus provides a uniform contact pressure over the array.

Thus there has been shown and described an electrical connector assembly wherein sound effective contact is made between pluralities of electrical conductors therein using a pressure exertion member which includes as part thereof a plurality of compressible, silicone rubber elements able to withstand relatively high temperatures and adverse operating conditions to still assure an effective, low magnitude, uniform predetermined pressure. This is achieved by the invention in a facile, relatively inexpensive manner. The defined preferred silicone rubber material is a molded elastomer, and is also readily adaptable for use as the resilient portion of the invention's pressure exertion member to even further facilitate assembly and operation of the invention. As understood herein, it is also within the scope of the invention to employ more than one exertion member in combination with singular, significantly larger first and/or second circuit members, to thus comprise a larger overall structure wherein several conductor members are connected. It is even further within the scope of the invention to utilize such exertion members in such a larger, overall structure wherein circuit members of several different types are employed. Still further, it is also possible to modify the invention described herein, e.g., to provide somewhat lesser overall exertion force, and still attain the objectives cited herein. For example, if a lesser exertion force is desired, it may be possible to utilize a second bilayered elastomeric member on the opposite side of the support member 45 between member 45 and cap 51. Such a second elastomeric member could of course be of the same configuration as the first and also directly aligned on said opposite side relative to the first elastomeric.

While there have been shown and described what are at present considered the preferred embodiments of the invention, it will be obvious to those skilled in the art that various changes and modification may be made therein without departing from the scope of the invention defined by the appended claims.

What is claimed is:

1. An electrical connector assembly comprising:

a first circuit member including a plurality of electrical conductors;

a second circuit member including a plurality of electrical conductors;

a pressure exertion member for exerting a predetermined pressure against said second circuit member to cause each of said electrical conductors of said second circuit member to electrically contact a respective one of said electrical conductors of said first circuit member, said pressure exertion member including a bilayered elastomeric element having a first layer including a plurality of openings spacedly located therein in a predetermined pattern and a second layer adjacent said first layer and including a plurality of upstanding projections located in a pre-established pattern relative to said pattern of openings in said first layer, each of said upstanding projections adapted for aligning with a respective one of said electrical conductors of said second circuit member and for engaging said circuit member to exert said predetermined pressure thereagainst; and means for retaining said pressure exertion member against said second circuit member to cause said exertion member to exert said pressure against said second circuit member.

2. The electrical connector according to claim 1 wherein said bilayered elastomeric element is comprised of silicone rubber.

3. The electrical connector assembly according to claim 1 wherein said first circuit member includes a substantially rigid substrate, said plurality of said electrical conductors of said first circuit member being located on said substrate.

4. The electrical connector assembly according to claim 3 wherein each of said electrical conductors of said first circuit member comprises a metallic pad.

5. The electrical connector assembly according to claim 1 wherein said second circuit member comprises a flexible substrate, each of said electrical conductors of said second circuit member being located on said flexible substrate.

6. The electrical connector assembly according to claim 5 wherein each of said electrical conductors of said second circuit member comprises a metallic pad.

7. The electrical connector assembly according to claim 1 wherein selected ones of said openings within said first layer are each located within said first layer substantially adjacent a respective one of said upstanding projections and substantially between said respective projection and a second projection adjacent thereto.

8. The electrical connector according to claim 7 wherein each of said selected ones of said openings is of substantially cylindrical configuration.

9. The electrical connector according to claim 8 wherein said upstanding projections are of a substantially box-like configuration.

10. The electrical connector according to claim 8 wherein said upstanding projections are of a substantially cylindrical configuration.

11. The electrical connector assembly according to claim 1 wherein said predetermined pressure provided by said pressure exertion member is within the range of from about ten to about fifty pounds per square inch.

12. The electrical connector assembly according to claim 1 wherein said first and second layers of said elastomeric element are each compressed from about fifteen to about thirty-five percent of their original, unstressed height during said exertion of said predetermined pressure.

* * * * *